US012352142B1

(12) United States Patent
Fardan

(10) Patent No.: US 12,352,142 B1
(45) Date of Patent: Jul. 8, 2025

(54) SYSTEMS AND METHODS FOR PRODUCING A MULTIPHASE FORMATION FLUID UTILIZING ELECTRIC SUBMERSIBLE PUMPS

(71) Applicant: Saudi Arabian Oil Company, Dhahran (SA)

(72) Inventor: Ali Al Fardan, Qatif (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/768,166

(22) Filed: Jul. 10, 2024

(51) Int. Cl.
*E21B 43/38* (2006.01)
*E21B 43/12* (2006.01)

(52) U.S. Cl.
CPC ..... *E21B 43/128* (2013.01); *E21B 43/38* (2013.01)

(58) Field of Classification Search
CPC ..... E21B 43/38; E21B 43/128
See application file for complete search history.

(56) References Cited

U.S. PATENT DOCUMENTS

| | | | | |
|---|---|---|---|---|
| 4,098,335 | A | 7/1978 | Goad | |
| 6,179,056 | B1 | 1/2001 | Smith | |
| 10,823,177 | B2 | 11/2020 | Sheth et al. | |
| 11,047,198 | B2 | 6/2021 | Ross | |
| 2005/0220645 | A1* | 10/2005 | Kerr | E21B 36/001 417/555.1 |
| 2011/0056699 | A1* | 3/2011 | Bjoroy | F04B 23/04 166/369 |
| 2021/0246771 | A1* | 8/2021 | Ejim | E21B 43/128 |

FOREIGN PATENT DOCUMENTS

| | | |
|---|---|---|
| CN | 110593846 A | 12/2019 |
| CN | 218092945 U | 12/2022 |

OTHER PUBLICATIONS

Prabhu et al., "Application of Dual ESP Completion with Remote Monitoring in Offshore Wells Having Variable Flow Conditions", Society of Petroleum Engineers, SPE-206902-MS, 2022.

RMS Pumtools, "Dual Concentric/Multiple Zone", https://www.rmspumptools.com/products/completion-systems-intervention-tools/esp-dual-bypass-systems/dual-concentricmultiple-zone, 2024.

* cited by examiner

*Primary Examiner* — David Carroll
(74) *Attorney, Agent, or Firm* — DINSMORE & SHOHL LLP

(57) ABSTRACT

A system for producing a multiphase formation fluid may comprise a wellbore; a packer positioned within the wellbore; first and second electric submersible pumps (ESP) coupled to the packer each comprising an ESP inlet end and an ESP outlet and respectively comprising first and second openings into an interior of the first ESP outlet end and the second ESP outlet end respectively; first and second gas separators being coupled to the ESP inlet ends of the first and second ESPs respectively; first and second tubing strings coupled to the packer; a first gate mechanism positioned within or outside the first ESP outlet end and configured to not obstruct the first opening when de-actuated and obstruct the first opening when actuated; and a second gate mechanism positioned within or outside the second ESP outlet end and configured to not obstruct the second opening when de-actuated and obstruct the second opening when actuated.

20 Claims, 2 Drawing Sheets

SYSTEMS AND METHODS FOR PRODUCING A MULTIPHASE FORMATION FLUID UTILIZING ELECTRIC SUBMERSIBLE PUMPS

TECHNICAL FIELD

Embodiments herein generally relate to systems and methods of systems for multiphase formation fluid production, and particularly to systems and methods for producing multiphase formation fluids utilizing electric submersible pumps.

BACKGROUND

Electric submersible pumps (ESP) are a common method of artificial lift used to efficiently extract large quantities of multiphase formation fluids (water, oil, and gas) from hydrocarbon-bearing subsurface formations. However, electric submersible pumps are known to struggle with producing formation fluids with a large ratio of gas, such that the choice of an electric submersible point may not be desired in such formations. Particularly electric submersible pumps operating in high gas/oil ratio formations are prone to a phenomenon referred to as 'gas locking', in which a gaseous phase of the multiphase formation fluid separates and occupies a predominant portion of the electric submersible pump. The electric submersible pump may then repeatedly compress and decompress the gaseous phase without properly passing the gas through electric submersible pump, resulting in loss of production, damage to the pump, or both.

SUMMARY

Accordingly, systems and methods are desired to allow the use of electric submersible pumps in subsurface formations, and particularly in high gas/oil ratio subsurface formations, without the risk of reduced production or damage to the pump due to gas locking. Embodiments herein address the aforementioned need by placing a gas separator on the inlet end of the ESP placed within a wellbore, such that at least a portion of the gaseous phase of the multiphase formation fluid will be separated prior to entry into the ESP and sent into the wellbore.

However, the separated gaseous phase still needs a flow path to surface, otherwise the gradual buildup of gas will eventually overwhelm the gas separator and ESP. Accordingly, the separated gaseous phase may be given a pathway up the annulus of the wellbore (the area between the casing and the ESP/associated tubing). However, this solution also comes with drawbacks. Traditional casings used to line wellbores are ordinarily made with grades of iron that may be vulnerable to corrosion, such as from corrosive species present in the multiphase formation fluid. Progressive corrosion to the casing may risk wellbore integrity, potentially resulting in the loss of the well or reduced production. Corrosive resistant grades of casing are chemical-based corrosion treatment may be used, but this adds additional cost.

Accordingly, systems and methods are desired to allow the use of two or more electric submersible pumps in subsurface formations, and particularly in high gas/oil ratio subsurface formations, without utilizing the wellbore annulus to produce the gaseous phase. Systems and methods herein address the aforementioned need by providing at least two tubing strings for separately producing the liquid phase and the gaseous phase of the multiphase formation fluid.

This is accomplished by providing a packer with fastening means for the at least two tubing strings, each tubing string having an ESP and gas separator below the packer. The packer may then be actuated to isolate an upper section of the wellbore above the packer and a lower section of the wellbore below the packer. Accordingly, the only permitted flow paths of the multiphase formation fluid are through the first and second (or third, fourth, etc.) tubing strings. Gate mechanisms operable to close an opening into the ESP outlet are also provided to allow gas to flow through the non-operating ESP(s) during production. Particularly, the gate mechanisms, when actuated, may operate to obstruct the openings which ordinarily provide a bypass flow path past the ESP inlet end. Accordingly, the gate mechanism for the operating ESP(s) may be actuated to obstruct the respective opening, whereas the gate mechanism for the non-operating ESP may be de-actuated, providing a flow path for the gaseous phase separated by the gas separator. This may remove the need to produce the separated gaseous phase through the annulus while also reducing the chance of gas locking.

Further, the openings and the gate mechanisms may allow the ESPs to be used in alternation, reducing the individual burden on each of the ESPs and providing a bridge to workover operations in the event one of the two ESPs breaks, such that the tubing string having the broken ESP may be used to flow the gas phase of the multiphase formation fluid until workover equipment is available on site to fix the broken ESP.

In accordance with one embodiment herein, a system for producing a multiphase formation fluid from a subsurface formation utilizing electric submersible pumps may comprise a surface collection point; a wellbore extending from the surface collection point to the subsurface formation; a packer positioned within the wellbore, the packer defining a first cavity and a second cavity, both the first cavity and the second cavity extending from a top surface of the packer to a bottom surface of the packer; first and second electric submersible pumps (ESP) each comprising an ESP inlet end and an ESP outlet end, wherein the ESP outlet end of the first ESP and the ESP outlet end of the second ESP are coupled to the bottom surface of the packer at the first and second cavities respectively, and the ESP outlet ends of the first and second ESPs respectively comprise a first opening into an interior of the first ESP outlet end and a second opening into an interior of the second ESP outlet end; first and second gas separators each comprising a multiphase formation fluid inlet, a gaseous phase outlet, and a liquid phase outlet, the liquid phase outlet of the first gas separator and the liquid phase outlet of the second gas separator being coupled to the ESP inlet ends of the first and second ESPs respectively;

At least the previous embodiment may further comprise first and second tubing strings coupled to the top surface of the packer at the first and second cavities respectively, wherein the first tubing string, the first ESP, and the first gas separator together define a first fluid pathway from the multiphase formation fluid inlet of the first gas separator to the surface collection point, and the second tubing string, the second ESP, and the second gas separator together define a second fluid pathway from the multiphase formation fluid inlet of the second gas separator to the surface collection point; a first gate mechanism positioned within or outside the first ESP outlet end and configured to not obstruct the first opening when de-actuated and obstruct the first opening when actuated, such that the first tubing string and the first ESP outlet end together define a third fluid pathway from the first opening to the surface collection point when the first gate mechanism is de-actuated; and a second gate mechanism positioned within or outside the second ESP outlet end and configured to not obstruct the second opening when de-actuated and obstruct the second opening when actuated, such that the second tubing string and the second ESP outlet end together define a fourth fluid pathway from the second opening to the surface collection point when the second gate mechanism is de-actuated.

Wherein, in at least the previous embodiments, the first and second gas separators may be configured to separate the multiphase formation fluid into a gaseous phase and a liquid phase, the first ESP may be configured to produce the liquid phase from the subsurface formation through the first and gas separator and the first tubing string to the surface collection point, and the second ESP may be configured to produce the liquid phase from the subsurface formation through the second gas separator and the second tubing string to the surface collection point.

In another embodiment, asystem for producing a multiphase formation fluid from a subsurface formation utilizing electric submersible pumps may comprise a surface collection point; a wellbore extending from the surface collection point to the subsurface formation; a packer positioned within the wellbore having a top surface and a bottom surface; first and second electric submersible pumps (ESP) each comprising an ESP inlet end and an ESP outlet end, wherein the first and second ESP outlet ends are coupled to the bottom surface of the packer and the first and second ESPs respectively comprise first and second openings into an interior of the first ESP outlet end and the second ESP outlet end respectively; first and second gas separators being coupled to the first and second ESP inlet ends respectively; first and second tubing strings coupled to the top surface of the packer; a first gate mechanism positioned within or outside the first ESP outlet end, wherein the first gate mechanism is configured to not obstruct the first opening when de-actuated and to obstruct the first opening when actuated; and a second gate mechanism positioned within or outside the second ESP outlet end, wherein the second gate mechanism is configured to not obstruct the second opening when de-actuated and obstruct the second opening when actuated.

BRIEF DESCRIPTION OF THE SEVERAL VIEWS OF THE DRAWINGS

The following detailed description of specific embodiments herein can be best understood when read in conjunction with the following drawings, where like structure is indicated with like reference numerals and in which.

FIGURE

These and other aspects of the present methods are described in further detail below with reference to the accompanying figures, in which one or more illustrated embodiments and/or arrangements of the systems and methods are shown. In the description of the embodiments that follows, like numerals denote like components across the various FIGURES. The systems and methods of the present application are not limited in any way to the illustrated embodiments and/or arrangements. It should be understood that the systems and methods as shown in the accompanying FIGURES are merely exemplary of the systems and methods of the present application, which can be embodied in various forms as appreciated by one skilled in the art. Therefore, it is to be understood that any structural and functional details disclosed herein are not to be interpreted as limiting the present systems and methods, but rather are provided as a representative embodiment and/or arrangement for teaching one skilled in the art one or more ways to implement the present systems and methods.

DETAILED DESCRIPTION

Figure 1A:
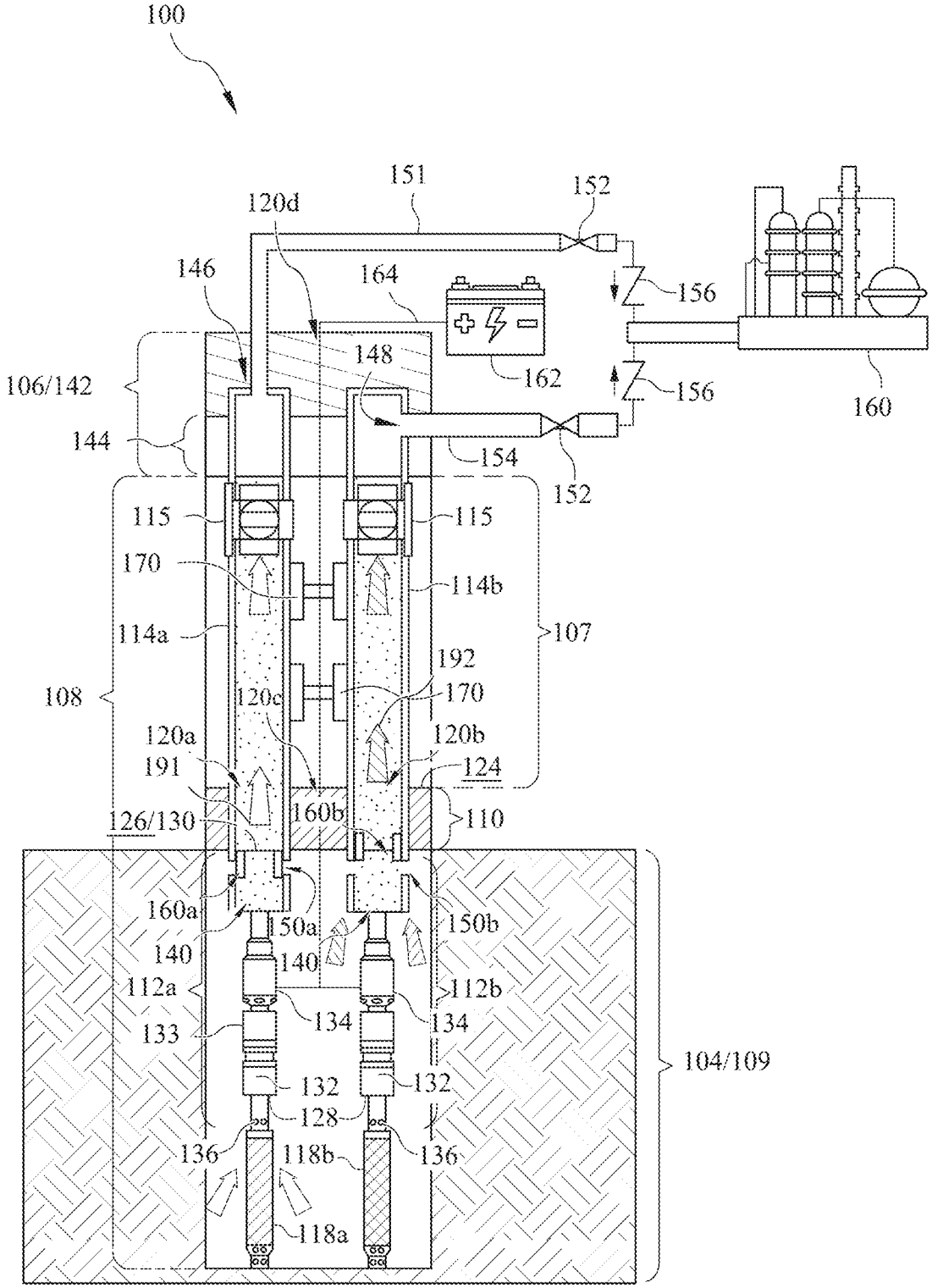
(FIG. 1A illustrates a wellbore diagram with the system configured for liquid phase production up the first tubing string, as described in embodiments herein.
Figure 1B:
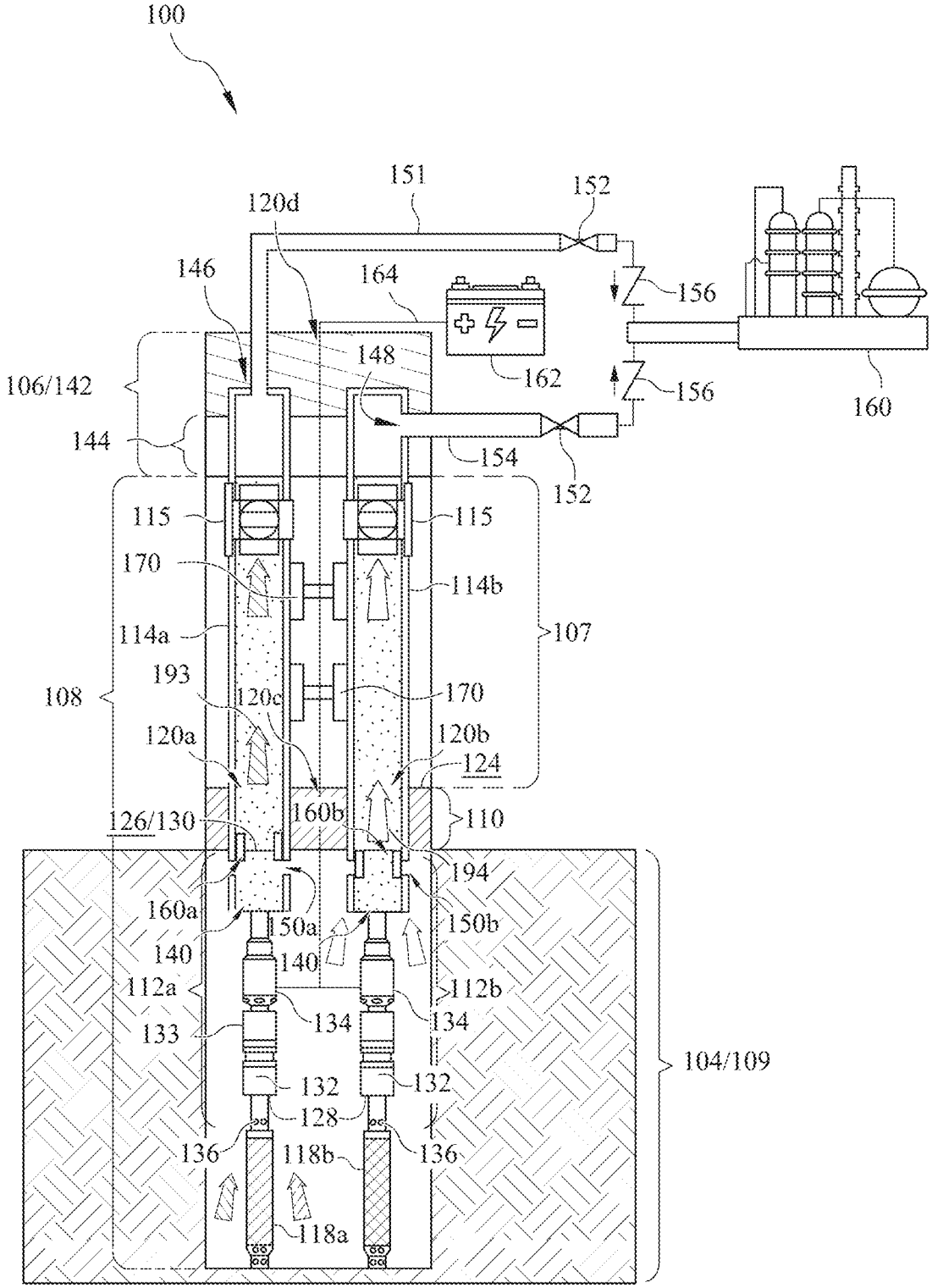
FIG. 1B illustrates the wellbore diagram and system of FIG. 1A, but configured for liquid phase production up the second tubing string, as described in embodiments herein.

Embodiments herein generally relate to systems and methods of systems for multiphase formation fluid production, and particularly to systems and methods for producing multiphase formation fluids utilizing electric submersible pumps. The methods and systems herein are described, in some instances, in the context of the subsurface formations of FIGS. 1A-1B. However, it should be understood that the methods and systems described herein may have applicability with other subsurface formations than are illustrated in FIGS. 1A-1B, as would be appreciated by those skilled in the art. Further, while two ESPs are shown in the drawings, it may be appreciated that any number of ESPs (such as 3, 4, 5, etc.) and the related components may be utilized in the system as required.

As used herein, the terms "downhole" and "uphole" may refer to a position within a wellbore relative to the surface, with uphole indicating direction or position closer to the surface and downhole referring to direction or position farther away from the surface. Similarly, as used herein, the terms "downward" and "upward" may refer to a position within a subterranean environment or subsurface formation relative to the surface, with upward indicating direction or position closer to the surface and downward referring to direction or position farther away from the surface.

As described herein, a "subsurface formation" may refer to a body of rock that is sufficiently distinctive and continuous from the surrounding rock bodies that the body of the rock may be mapped as a distinct entity. A subsurface formation is, therefore, sufficiently homogenous to form a single identifiable unit containing similar properties throughout the subsurface formation, including, but not limited to, porosity and permeability.

As used herein, "wellbore," may refer to a drilled hole or borehole extending from the surface of the Earth down to the subsurface formation, including the openhole or uncased portion. The wellbore may form a pathway capable of permitting fluids to traverse between the surface and the subsurface formation. The wellbore may include at least a portion of a fluid conduit that links the interior of the wellbore to the surface. The fluid conduit connecting the interior of the wellbore to the surface may be capable of permitting regulated fluid flow from the interior of the wellbore to the surface and may permit access between equipment on the surface and the interior of the wellbore.

As used herein, a "wellbore wall" may refer to the interface through which fluid may transition between the subsurface formation and the interior of the wellbore. The wellbore wall may be unlined (that is, bare rock or formation) to permit such interaction with the subsurface formation or lined, such as by a tubular string, to prevent such interactions. The wellbore wall may also define the void volume of the wellbore.

Referring now to FIGS. 1A-1B, a wellbore diagram of a system 100 for producing a multiphase formation fluid is illustrated. As shown in FIGS. 1A and 1B, the system 100 may comprise a subsurface formation 104, a surface collection point 106, a wellbore 108, a packer 110, a first electric submersible pump 112*a*, a first tubing string 114*a*, a first gas separator 118*a*, a second electric submersible pump 112*b*, a second tubing string 114*b*, and a second gas separator 118*b*. As also shown in FIGS. 1A-1B, the system 100 may further comprise a first gate mechanism 160*a* and a second gate mechanism 160*b*.

As previously stated, the system 100 may comprise the subsurface formation 104, the surface collection point 106, and the wellbore 108. As shown in FIGS. 1A and 1B, the wellbore 108 may extend from the surface collection point 106 to the subsurface formation 104. Also as shown in FIGS. 1A and 1B, the subsurface formation 104 may comprise and/or contain the multiphase formation fluid. The multiphase formation fluid may comprise a liquid phase and a gaseous phase. The liquid phase may comprise liquid hydrocarbons and/or water. The gaseous phase may comprise hydrocarbon gases and/or acid gases (such as, but not limited to hydrogen sulfide, carbon dioxide, and carbon monoxide).

As described herein, the water may be pure water or any aqueous solution such as those selected from the group consisting of formation water; filtered seawater; untreated seawater; natural salt water; brackish salt water; saturated salt water; synthetic brine; mineral waters; potable water containing one or more dissolved salts, minerals, and organic materials; non-potable water containing one or more dissolved salts, minerals, and organic materials; deionized water; tap water; distilled water; fresh water; or combinations thereof.

The subsurface formation 104, and thereby the multiphase formation fluid may have a temperature of at least 30° C., such as from 30° C. to 80° C., from 80° C. to 100° C., from 100° C. to 150° C., from 150° C. to 200° C., from 200° C. to 400° C., or any combination of the previous ranges or smaller range therein, such as from 50° C. to 200° C. The subsurface formation 104, and thereby the multiphase formation fluid, may also have a pressure of at least 500 psi, such as from 500 psi to 1,000 psi, from 1,000 psi to 2,000 psi, from 2,000 psi to 3,000 psi, from 3,000 psi to 4,000 psi, from 4,000 psi to 6,000 psi, from 6,000 psi to 10,000 psi, or any combination of the previous ranges or smaller range therein, such as from 500 psi to 4,000 psi.

Still referring to FIGS. 1A and 1B, and as previously described, the system 100 may also comprise the packer 110. The packer 110 may be positioned within the wellbore 108, the packer 110 defining a first cavity 120*a* and a second cavity 120*b*, both the first cavity 120*a* and the second cavity 120*b* extending from a top surface 124 of the packer 110 to a bottom surface 126 of the packer 110. In so having, the packer 110 may also be regarded as a dual-string packer 110. Although not illustrated, the first cavity 120*a* and the second cavity 120*b* may each comprise fastening means on the top surface 124 and/or the bottom surface 126 for coupling another component thereto, as explained in further detail hereinbelow. The fastening means may be any understood in the art, such as, but not limited to, male-female threaded connections. As shown in FIGS. 1A and 1B, the packer 110 may also comprise one or more swellable, inflatable, or radially extendible means, that, when actuated, may isolate an upper section 107 of the wellbore 108 above the packer 110 and a lower section 109 of the wellbore 108 below the packer 110, as would be understood in the art. As illustrated in FIGS. 1A and 1B, the lower section 109 of the wellbore 108 may also coincide with the subsurface formation 104, although this is not necessary. Without being limited by theory, such swellable, inflatable, or radially extendible means may provide isolation that may only permit flow of the multiphase formation fluid through the first and second cavities 120*a*/120*b* of the packer 110.

Still referring to FIGS. 1A and 1B, and as previously described, the system 100 may also comprise the first electric submersible pump 112*a* and the second electric submersible pump 112*b*, the pumps of which may be similar or identical to each other. As illustrated in FIGS. 1A and 1B, the electric submersible pumps 112*a*/112*b* may comprise an electric submersible pump inlet 128 and an electric submersible pump outlet end 130. The electric submersible pump outlet end 130 may be coupled to the bottom surface 126 of the packer 110 such as at first cavity 120*a* through the fastening means. Also as illustrated in FIGS. 1A and 1B, the electric submersible pumps 112*a*/112*b* may further comprise a motor section 132, a seal section 133, and a pump section 134. The motor section 132 may be configured to supply drive to the pump section 134. The pump section 134 may be configured to lift the multiphase formation fluid through the first and second electric submersible pumps 112*a*/112*b*. The seal section 133 may be configured to prevent the multiphase formation fluid from entering the motor section 132. Accordingly, the first and second electric submersible pumps 112*a*/112*b* may be configured to produce the multiphase formation fluid from the subsurface formation 104 through the electric submersible pump inlet end 128 and through the electric submersible pump outlet end 130.

As previously described, the system 100 may also comprise the first and second gas separators 118*a*/118*b*. The first and second gas separators 118*a*/118*b* may comprise a multiphase formation fluid inlet 136, a gaseous phase outlet, and a liquid phase outlet, the liquid phase outlet 140 coupled to the inlet end of the first and second electric submersible pumps 112*a*/112*b*. The gas separator 118 may comprise, but may not be limited to, a centrifugal gas separator, a turbulent-flow gas separator, or any other category of gas separator known in the art. Accordingly, without being limited by theory, the first and second gas separators 118*a*/118*b* may be configured to separate at least a portion of the gaseous phase in the multiphase formation fluid to produce the gaseous phase out the gaseous phase outlet and the liquid phase out the liquid phase outlet 140. The liquid phase may then enter the electric submersible pump inlet end 128 where it may be lifted by the pump section 134 to the electric submersible pump outlet end 130.

Still referring to FIGS. 1A and 1B, and as previously described, the system 100 may also comprise the first and second tubing strings 114*a*/114*b*. The first tubing string 114*a* may be coupled and fluidly connected to the top surface 124 of the packer 110, such as at the first cavity 120*a* through the fastening means, as well as to the surface collection point 106. Accordingly, as illustrated in FIGS. 1A and 1B, the first tubing string 114*a*, the first cavity 120*a*, the electric submersible pump 112, and the first gas separator 118*a* may together define a first fluid pathway 191 from the multiphase formation fluid inlet 136 of the first gas separator 118*a* to the surface collection point 106.

Similarly, the second tubing string 114*b* may be coupled and fluidly connected to the top surface 124 of the packer 110, such as at the second cavity 120*b* through the fastening means, as well as to the surface collection point 106. Accordingly, as illustrated in FIGS. 1A and 1B, the second tubing string 114*b*, the second cavity 120*b*, the second electric submersible pump 112*b*, and the second gas separator 118*b* may together define a second fluid pathway 192 from the multiphase formation fluid inlet 136 of the second gas separator 118*b* to the surface collection point 106.

Accordingly, the first and second electric submersible pumps 112*a*/112*b* may be configured to produce the multiphase formation fluid from the subsurface formation 104 through the first and second gas separators 118*a*/118*b* and the first and second tubing strings 114*a*/114*b* to the surface collection point 106. The first and second tubing strings 114*a*/114*b* may each also comprise a subsurface safety valve 115, which may be configured to block fluid flow in the respective tubing string when actuated, thus serving as a backup well control apparatus in the event any surface control apparatuses fail.

Without being limited by theory, and as previously stated, by producing the gaseous phase and the liquid phase of the multiphase formation fluid up the tubing strings 114*a*/114*b*, rather than up the casing through the wellbore annulus, corrosion of the casing by one or more corrosive species within the multiphase formation fluid may be avoided. For example, and without being limited by theory, the multiphase formation fluid may comprise corrosive species such as chloride-containing water (which may break down to HCl at increased temperatures), carbon dioxides (formation of carbonic acid which reacts with the casing), organic chlorides (which may break down to HCl at increased temperatures), organic acids (such as napthenic acids), sulfur-containing species (can form iron sulfide upon reaction with the casing), and bacteria (bacteria-induced corrosion forming sulfur-containing species). This may minimize the risk of corrosion to the wellbore casing uphole of the packer 110 and thus minimize risks to wellbore stability.

As previously stated, the system 100 may comprise the first gate mechanism 160*a* and the second gate mechanism 160*b*. As shown in FIGS. 1A and 1B, the first and second gate mechanisms 160*a*/160*b* may be positioned with the first and second ESPs 112*a*/112*b*, and particularly within or outside (i.e. on an interior or exterior of) the respective first and second ESP outlet ends 130. Along with the gate mechanisms 160*a*/160*b*, the first and second ESPs 112*a*/112*b* may respectively comprise a first opening 150*a* opening into an interior of the first ESP 112*a* outlet end 130 and a second opening 150*b* opening into an interior of the second ESP 112*b* outlet end 130.

As shown in FIG. 1A, in an un-actuated/de-actuated condition, the second gate mechanism 160*b* may be configured to not obstruct the second opening 150*b*, such that the second tubing string 114*b* and the first ESP 112*b* outlet end 130 may together define a fourth fluid pathway 194 from the second opening 150*b* to the surface collection point 106. Similarly as shown in FIG. 1B, the first gate mechanism 160*a* in the un-actuated/de-actuated condition may be configured to not obstruct the first opening 150*a*, such that the first tubing string 114*a* and the first ESP 112*a* outlet end 130 may together define a third fluid pathway 193 from the first opening 150*a* to the surface collection point 106.

As shown in FIG. 1A, in the actuated condition, the first gate mechanism 160*a* may be configured to obstruct the first opening 150*a*, such that bypass from the multiphase formation fluid inlet 136 of the first gas separator 118*a* (i.e. gas flow through the third fluid pathway) is prevented. Similarly, as shown in FIG. 1B, in the actuated condition, the second gate mechanism 160*b* may be configured to obstruct the second opening 150*b*, such that bypass from the multiphase formation fluid inlet 136 of the second gas separator 118*b* (i.e. gas flow through the fourth fluid pathway) is prevented.

Consequently, by coordinating the system 100 such that the tubing string having the active ESP also has the actuated gate mechanism, the in-active tubing string and ESP may be used as a bypass string for the gas phase, i.e. may receive the gas phase separated by the gas separators 118*a*/118*b* and produce the same to the surface collection point 106. Further, by actuating the packer 110, the system 100 may be configured such that the only permitted flow paths of the multiphase formation fluid are through the first and second tubing strings. Further, without being limited by theory, the provision of the other ESP and gate mechanism may allow these arrangements to be cycled, such that one ESP is not relied upon to too great a degree in operation. Additionally, the use of multiple ESPs may provide a bridge to workover operations in the event one of the two ESPs breaks, such that the tubing string having the broken ESP may be used to flow the gas phase of the multiphase formation fluid (the respective gate mechanism may be de-actuated) until workover equipment is available on site to fix the broken ESP.

In embodiments, the first and second gate mechanisms 160*a*/160*b* each may be a sliding sleeve, including but not limited to a mechanically actuated sliding sleeve, a hydraulically actuated sliding sleeve, or both.

In such systems 100 comprising the mechanically actuated sliding sleeve, the gate mechanisms 160*a*/160*b* each may comprise an internal sleeve operable to translate uphole or downhole when engaged with a first shifting tool, as may be understood in the art with respect to sliding sleeves used in hydraulic fracturing. The shifting tool may be inserted into the wellbore 108 via wireline or other means as understood in the art. The first shifting tool may in turn have an engagement profile configured to engage the internal sleeve of the gate mechanism, such that insertion and/or jarring of the first shifting tool translates the sleeve downward. Further, the internal sleeve may further comprise a bottom seat and/or bottom lock, such that the first shifting tool may be retrieved from the internal sleeve past a certain translation amount without resetting the internal sleeve.

To de-actuate the gate mechanism and the internal sleeve, a second shifting tool may be inserted into the sliding sleeve similar to the first shifting tool. The second shifting tool may have an engagement profile configured to engage the bottom seat and/or bottom lock, freeing the internal sleeve for translation uphole. Further, the internal sleeve may further comprise a top seat and/or lock, such that the second shifting tool may be retrieved from the internal sleeve past a certain translation amount without remaining stuck on the internal sleeve.

In such systems 100 comprising the hydraulically actuated sliding sleeve, the gate mechanisms 160*a*/160*b* may comprise an internal sleeve or external sleeve operable to translate uphole or downhole when supplied with a hydraulic fluid or force therefrom. Accordingly, the gate mechanism may be actuated by supplying the hydraulic fluid to the internal/external sleeve, such as through a pump connected to the sliding sleeve/internal sleeve by a conduit extending to the surface collection point 106. Further, the gate mechanism may be de-actuated by withdrawing the hydraulic fluid from the sliding sleeve/internal sleeve.

As previously described, the system 100 may comprise the surface collection point 106. The surface collection point 106 may comprise a wellhead configured to accept the first tubing string 114*a* and the second tubing string 114*b*, such that the wellhead may be regarded as a dual-string wellhead 142. The dual-string wellhead 142 may comprise a tubing hanger 144 configured to suspend the first tubing string 114*a* and the second tubing string 114*b*, as well as any associated components, from the dual-string wellhead 142. The dual-string wellhead 142 may also comprise a first wellhead flange 146 fluidly connected to the first tubing string 114*a* and a second wellhead flange 148 fluidly connected to the second tubing string 114*b*. The first wellhead flange 146 may itself be fluidly connected and coupled to a first length of pipe 151, the first length of pipe 151 of which may be fluidly connected and coupled to one or more of a downstream choke valve 152, a downstream check valve 156, or a downstream treatment facility 160. Similarly, the second wellhead flange 148 may itself be fluidly connected and coupled to a second length of pipe 154, the second length of pipe 154 of which may be fluidly connected and coupled to a downstream choke valve 152, a downstream check valve 156, or the downstream treatment facility 160. The downstream choke valves 152 may be configured to be adjustable such that the flow rate and outlet pressure of the liquid phase of the multiphase formation fluid may be adjustable. The downstream treatment facility 160 may comprise one or more hydrocarbon refining units, such as separators, reactors, dehydration systems, sweetening systems, or the like.

As previously described, the system 100 may comprise the first and second electric submersible pumps 112*a* and 112*b*. However, the system 100 may additionally comprise a power source 162 positioned at the surface collection point 106 to provide power to the first and second electric submersible pumps 112*a*/112*b*. Additionally, as shown in FIGS. 1A and 1B, the system 100 may also comprise one or more power cables 164, the one or more power cables 164 extending from the power source 162 to the first and second electric submersible pumps 112*a*/112*b*, the one or more power cables 164 electrically coupling the power source 162 to the electric submersible pumps. To permit the connection of the power source 162 and the electric submersible pumps 112*a*/112*b*, the packer 110 may further define a third cavity 120*c* extending from the top surface 124 of the packer 110 to the bottom surface 126, the third cavity 120*c* sized to accept the one or more power cables 164. Similarly, the dual-string wellhead 142 may further define a fourth cavity 120*d* sized to accept the one or more power cables 164. While the one or more power cables 164 are stated to be electrically coupled to the electric submersible pumps, where the electric submersible pumps comprise the motor section 132 and the pump section 134, the one or more power cables 164 may actually be electrically coupled to the motor sections 132.

As previously stated, the system 100 may comprise the one or more power cables 164 extending from the power source 162 to the electric submersible pumps. However, the system 100 may also comprise a plurality of tubing clamps 170 spaced along the length of the first and second tubing strings 114*a*/114*b*. The plurality of tubing clamps 170 may be coupled to the one or more cables, the first tubing string 114*a*, and the second tubing string 114*b*, for securing the one or more power cables 164 in a fixed line position and preventing the one or more power cables 164 from wrapping around the first tubing string 114*a*, the second tubing string 114*b*, or both, and potentially being damaged. Although not illustrated in FIGS. 1A and 1B, the upper section 107 may be filled with an inhibited fluid, such as an inhibited brine, to protect the casing of the wellbore 108 from corrosion, as well as provide a pressure seal against the packer 110 leaking multiphase formation fluid to the surface collection point 106 through the upper section 107.

As previously stated, embodiments herein may also be directed to methods for multiphase formation fluid production utilizing the electric submersible pumps. The methods may initially comprise providing any of the systems 100 previously mentioned. The method may initially comprise actuating the packer 110 to isolate the upper section 107 of the wellbore 108 and the lower section 109 of the wellbore 108.

The method may also comprise producing the liquid phase of the multiphase formation fluid along the first tubing string 114*a* utilizing the first electric submersible pump 112*a*, wherein the first gate mechanism 160*a* has been actuated so as to obstruct the first opening 150*a*. The method may also comprise producing the gaseous phase of the multiphase formation fluid along the second tubing string 114*b* utilizing the first gas separator 118*a* and the second opening 150*b*.

As previously stated, the electric submersible pumps 112*a*/112*b* and the gate mechanisms 160*a*/160*b* may also be alternated to avoid overreliance on one of the electric submersible pumps 112*a*/112*b*. Accordingly, the method may further comprise halting production of the liquid phase at the first ESP 112*a*; de-actuating the first gate mechanism 160*a*, thereby un-obstructing the first opening 150*a*; actuating the second gate mechanism 160*b*, thereby obstructing the second opening 150*b*; producing the liquid phase along the second tubing string 114*b* utilizing the second ESP 112*b*; and producing the gaseous phase along the first tubing string 114*a* utilizing the second gas separator 118*b* and the first opening 150*a*.

In such embodiments wherein the sliding sleeves are mechanically actuated sliding sleeves, actuating the first or second gate mechanisms 160*a*/160*b* may comprise inserting the first shifting tool into the respective tubing string and engaging the respective sliding sleeve, thereby translating the respective sliding sleeve over the respective opening and obstructing the respective opening. Further de-actuating the first or second gate mechanism 160*a*/160*b* may comprise withdrawing the second shifting tool from the respective tubing and engaging the respective sliding sleeve, thereby translating the respective sliding sleeve away from the respective opening and un-obstructing the respective opening.

In such embodiments wherein the sliding sleeves are hydraulically actuated sliding sleeves, actuating the first or second gate mechanisms may comprises supplying a hydraulic fluid to the sliding sleeve through a pump connected to the sliding sleeve via a conduit to the surface collection point 106, thereby translating the respective sliding sleeve over the respective opening and obstructing the respective opening; and de-actuating the first or second gate mechanisms comprises withdrawing the hydraulic fluid from the sliding sleeves, thereby translating the respective sliding sleeve away from the respective opening and un-obstructing the respective opening.

It is noted that recitations herein of a component of the present embodiments being "operable" or "sufficient" in a particular way, to embody a particular property, or to function in a particular manner, are structural recitations, as opposed to recitations of intended use. More specifically, the references in the present embodiments to the manner in which a component is "operable" or "sufficient" denotes an existing physical condition of the component and, as such, is to be taken as a definite recitation of the structural characteristics of the component.

The singular forms "a," "an" and "the" include plural referents, unless the context clearly dictates otherwise.

Herein, ranges are provided. It is envisioned that each discrete value encompassed by the ranges are also included. Additionally, the ranges which may be formed by each discrete value encompassed by the explicitly disclosed ranges are equally envisioned.

As used herein and in the appended claims, the words "comprise," "has," "include", and all grammatical variations thereof are each intended to have an open, non-limiting meaning that does not exclude additional elements or steps.

As used herein, terms such as "first" and "second" are arbitrarily assigned and are merely intended to differentiate between two or more instances or components. It is to be understood that the words "first" and "second" serve no other purpose and are not part of the name or description of the component, nor do they necessarily define a relative location, position, or order of the component. Furthermore, it is to be understood that the mere use of the term "first" and "second" does not require that there be any "third" component, although that possibility is contemplated under the scope herein.

Having described the subject matter herein in detail and by reference to specific embodiments, it is noted that the various details disclosed herein should not be taken to imply that these details relate to elements that are essential components of the various embodiments described herein. Further, it will be apparent that modifications and variations are possible without departing from the scope herein, including, but not limited to, embodiments defined in the appended claims.

It is noted that one or more of the following claims utilize the term "wherein" as a transitional phrase. For the purposes of defining the present invention, it is noted that this term is introduced in the claims as an open-ended transitional phrase that is used to introduce a recitation of a series of characteristics of the structure and should be interpreted in like manner as the more commonly used open-ended preamble term "comprising."

What is claimed is:

1. A system for producing a multiphase formation fluid from a subsurface formation utilizing electric submersible pumps, the system comprising:

a surface collection point;

a wellbore extending from the surface collection point to the subsurface formation;

a packer positioned within the wellbore, the packer defining a first cavity and a second cavity, both the first cavity and the second cavity extending from a top surface of the packer to a bottom surface of the packer;

first and second electric submersible pumps (ESP) each comprising an ESP inlet end and an ESP outlet end, wherein the ESP outlet end of the first ESP and the ESP outlet end of the second ESP are coupled to the bottom surface of the packer at the first and second cavities respectively, and the ESP outlet ends of the first and second ESPs respectively comprise a first opening into an interior of the first ESP outlet end and a second opening into an interior of the second ESP outlet end;

first and second gas separators each comprising a multiphase formation fluid inlet, a gaseous phase outlet, and a liquid phase outlet, the liquid phase outlet of the first gas separator and the liquid phase outlet of the second gas separator being coupled to the ESP inlet ends of the first and second ESPs respectively;

first and second tubing strings coupled to the top surface of the packer at the first and second cavities respectively, wherein the first tubing string, the first ESP, and the first gas separator together define a first fluid pathway from the multiphase formation fluid inlet of the first gas separator to the surface collection point, and the second tubing string, the second ESP, and the second gas separator together define a second fluid pathway from the multiphase formation fluid inlet of the second gas separator to the surface collection point;

a first gate mechanism positioned within or outside the first ESP outlet end and configured to not obstruct the first opening when de-actuated and obstruct the first opening when actuated, such that the first tubing string and the first ESP outlet end together define a third fluid pathway from the first opening to the surface collection point when the first gate mechanism is de-actuated; and a second gate mechanism positioned within or outside the second ESP outlet end and configured to not obstruct the second opening when de-actuated and obstruct the second opening when actuated, such that the second tubing string and the second ESP outlet end together define a fourth fluid pathway from the second opening to the surface collection point when the second gate mechanism is de-actuated, and wherein the first and second gas separators are configured to separate the multiphase formation fluid into a gaseous phase and a liquid phase, the first ESP is configured to produce the liquid phase from the subsurface formation through the first gas separator and the first tubing string to the surface collection point, and the second ESP is configured to produce the liquid phase from the subsurface formation through the second gas separator and the second tubing string to the surface collection point.

2. The system of claim 1, wherein the first and second gate mechanisms are sliding sleeves.

3. The system of claim 1, wherein the first and second ESPs each further comprise a motor section, a seal section and a pump section, the motor section configured to supply drive to the pump section, the seal section configured to prevent the multiphase formation fluid from entering the motor section, and the pump section configured to lift the multiphase formation fluid through the respective gas separator and tubing string to the surface collection point.

4. The system of claim 1, further comprising:

a power source positioned at the surface collection point; and one or more power cables extending from the power source to the first ESP and the second ESP, the one or more power cables electrically coupled to the first ESP, the second ESP, and the power source.

5. The system of claim 4, wherein the packer further defines a third cavity extending from the top surface of the packer to the bottom surface, the third cavity sized to accept the one or more power cables.

6. The system of claim 4, further comprising a plurality of tubing clamps spaced along a length of the first and second tubing strings, wherein:

the plurality of tubing clamps are coupled to both the first tubing string and the second tubing string, and the one or more power cables are coupled to the plurality of the tubing clamps.

7. The system of claim 5, wherein the surface collection point comprises a dual-string wellhead defining a fourth cavity sized to accept the one or more power cables.

8. The system of claim 1, wherein the surface collection point comprises a dual-string wellhead having a first wellhead flange fluidly connected to the first tubing string and a second wellhead flange fluidly connected to the second tubing string.

9. The system of claim 8, wherein the dual-string wellhead comprises a tubing hanger configured to suspend the first tubing string and the second tubing string from the dual-string wellhead.

10. The system of claim 8, wherein the dual-string wellhead further comprises:

a first length of pipe fluidly connected to the first wellhead flange and a downstream treatment facility; and a second length of pipe fluidly connected to the second wellhead flange and a downstream treatment facility.

11. The system of claim 1, wherein each gas separator comprises a centrifugal gas separator or a turbulent-flow gas separator.

12. A method of utilizing the system of claim 1, the method comprising:

producing a liquid phase of the multiphase formation fluid along the first tubing string utilizing the first ESP, wherein the first gate mechanism has been actuated so as to obstruct the first opening; and producing a gaseous phase of the multiphase formation fluid along the second tubing string utilizing the first gas separator and the second opening.

13. The method of claim 12, further comprising:

halting production of the liquid phase at the first ESP;

de-actuating the first gate mechanism, thereby un-obstructing the first opening;

actuating the second gate mechanism, thereby obstructing the second opening;

producing the liquid phase along the second tubing string utilizing the second ESP; and producing the gaseous phase along the first tubing string utilizing the second gas separator and the first opening.

14. The method of claim 13, wherein:

the first and second gate mechanisms are sliding sleeves;

actuating the first or second gate mechanisms comprises inserting a first shifting tool into the respective tubing string and engaging the respective sliding sleeve, thereby translating the respective sliding sleeve over the respective opening and obstructing the respective opening; and de-actuating the first or second gate mechanisms comprises withdrawing a second shifting tool from the respective tubing and engaging the respective sliding sleeve, thereby translating the respective sliding sleeve away from the respective opening and un-obstructing the respective opening.

15. The method of claim 12, further comprising actuating the packer prior to producing the liquid phase.

16. The method of claim 12, wherein the system further comprises:

a plurality of tubing clamps spaced along the length of the first tubing string, the plurality of tubing clamps coupled to both the first tubing string and the second tubing string; and one or more power cables coupled to the plurality of the tubing clamps, and wherein the packer further defines a third cavity extending from the top surface of the packer to the bottom surface, the third cavity sized to accept the one or more power cables, each ESP further comprises a motor section and a pump section, the motor section configured to supply drive to the pump section and the pump section configured to lift the multiphase formation fluid through the gas separator and the first tubing string to the surface collection point, the one or more power cables extend from the surface collection point to each ESP and are electrically coupled to the motor section of each ESP as well as a power source positioned at the surface collection point, and the surface collection point comprises a dual-string wellhead defining a fourth cavity sized to accept the one or more power cables.

17. The method of claim 12, wherein each gas separator comprises a centrifugal gas separator or a turbulent-flow gas separator.

18. A system for producing a multiphase formation fluid from a subsurface formation utilizing electric submersible pumps, the system comprising:

a surface collection point;

a wellbore extending from the surface collection point to the subsurface formation;

a packer positioned within the wellbore, the packer having a top surface and a bottom surface;

first and second electric submersible pumps (ESP) each comprising an ESP inlet end and an ESP outlet end, wherein the first and second ESP outlet ends are coupled to the bottom surface of the packer and the first and second ESPs respectively comprise first and second openings into an interior of the first and second ESP outlet ends respectively;

first and second gas separators being coupled to the first and second ESP inlet ends respectively;

first and second tubing strings coupled to the top surface of the packer;

a first gate mechanism positioned within or outside the first ESP outlet end, wherein the first gate mechanism is configured to not obstruct the first opening when de-actuated and to obstruct the first opening when actuated; and a second gate mechanism positioned within or outside the second ESP outlet end, wherein the second gate mechanism is configured to not obstruct the second opening when de-actuated and obstruct the second opening when actuated.

19. A method of utilizing the system of claim 18, the method comprising:

producing a liquid phase of the multiphase formation fluid along the first tubing string utilizing the first ESP, wherein the first gate mechanism has been actuated so as to obstruct the first opening; and producing a gaseous phase of the multiphase formation fluid along the second tubing string utilizing the first gas separator and the second opening.

20. The method of claim 19, further comprising:

halting production of the liquid phase at the first ESP;

de-actuating the first gate mechanism, thereby un-obstructing the first opening;

actuating the second gate mechanism, thereby obstructing the second opening;

producing the liquid phase along the second tubing string utilizing the second ESP; and producing the gaseous phase along the first tubing string utilizing the second gas separator and the first opening.

* * * * *